United States Patent [19]

Tomizawa et al.

[11] 4,434,495

[45] Feb. 28, 1984

[54] COOLING PIPE STRUCTURE FOR ARC FURNACE

[75] Inventors: Fumio Tomizawa, Yokohama; Masayuki Aoshika, Kurihashi, both of Japan

[73] Assignee: Ishikawajima-Harima Jukogyo Kabushiki Kaisha, Japan

[21] Appl. No.: 380,945

[22] Filed: May 21, 1982

[30] Foreign Application Priority Data

Feb. 23, 1982 [JP] Japan ..... 57-23650[U]

[51] Int. Cl.[3] ..... F27D 1/12

[52] U.S. Cl. ..... 373/76

[58] Field of Search ..... 373/74, 75, 76, 73; 266/280, 286; 432/248; 110/336

[56] References Cited

U.S. PATENT DOCUMENTS 4,216,348 8/1980 Greenberger ..... 373/74

4,345,332 8/1982 Wronka ..... 373/74

*Primary Examiner*—Roy N. Envall, Jr.

[57] ABSTRACT

In the present invention, many cooling pipes are arranged horizontally at least in any one of the walls or roof of a furnace, to be fitted at the respective ends on both sides with supporting pipes provided outside the furnace, to let the cooling medium flow in one system for high cooling efficiency and long life. The cooling pipes may be arranged in ladder fashion or in a similar way, to keep the splash film stable, thereby preventing the decrease of the thermal efficiency of the furnace.

3 Claims, 13 Drawing Figures

COOLING PIPE STRUCTURE FOR ARC FURNACE

BACKGROUND OF THE INVENTION

The present invention relates to a cooling pipe structure for an arc furnace used for steel making or the like.

In recent years, arc furnaces for steel making are used in increasingly hard conditions, since they have become larger and are operated at higher voltages and higher currents because of the larger capacity transformers adopted for such larger-sized furnaces. Therefore, the life of the refractory linings used for the furnace bodies have become very short.

In this situation, instead of refractories such as bricks, various types of metallic water-cooled furnace structures such as jacket or box type structure U.S. Pat. No. 4,207,060, steel pipes enclosed in casting, piping panel, etc. have been contrived. To overcome the disadvantage of jacket or box structure, viz. the disadvantage that the metallic plates in portions exposed to the high heat in the furnace are liable to be deformed and/or cracked by the thermal fatigue and thermal deterioration caused by repeated expansion and contraction, several different cooling water pipe structures have been contrived and used; one prior art structure shown in U.S. Pat. Nos. 3,843,106 and 4,021,603 has the cooling water pipes enclosed in casting, a second prior art structure shown in U.S. Pat. No. 3,829,595 has the cooling water enclosed in casting embedded in bricks at predetermined intervals, and a third prior art structure shown in U.S. Pat. No. 4,207,060 has the cooling water pipes formed into serpentine coil to define a cooled panel.

The structure shown in U.S. Pat. Nos. 3,843,106 and 4,021,603 is excellent in mechanical strength and spark resistance through scraps with respect to graphite electrodes. Upon generation of spark, merely the surrounding casting is partially melted, blown off and scraped off, and the pipes through which water flows are not affected by the spark, so that no water leakage occurs. However, this structure is disadvantageously heavy and expensive. The structure of U.S. Pat. No. 3,829,595 is very low in the effect of cooling the surrounding bricks by cooling water pipes embedded into the cast steel, and involves the difficulty of brick laying. Therefore, it is little adopted now. The structure of U.S. Pat. No. 4,207,060 has the cooling water pipes bent or has U-shaped pipes welded, to be zigzag, neighboring sections of pipes being arranged in a contacting relation, each of the pipe sections being connected along its length to the neighboring pipe sections of cooling pipe by a welded joint. In summary, each pipe of this panel is free of thermal deformation, free of thermal expansion and free supporting. Therefore, weld joints such as U-shaped caps exist in portions exposed to the high heat in the furnace, and cracks threaten to be caused by the thermal fatigue and thermal deterioration caused by repeated thermal expansion and contraction.

In addition, the different structures of the prior art of the cooling water pipe panels have almost a flat and therefore, they do not allow a thick splash film of slag, etc. to adhere and be held. As a result, it makes the large heat loss of the furnace.

The object of the present invention is to overcome the above mentioned disadvantages of these water cooled furnace structures, providing cooling structures which are safe, low in heat loss and long in life.

Examples of the present invention are described below with reference to the drawings.

DETAILED DESCRIPTION OF THE PREFERRED EMBODIMENTS

Figure 1:
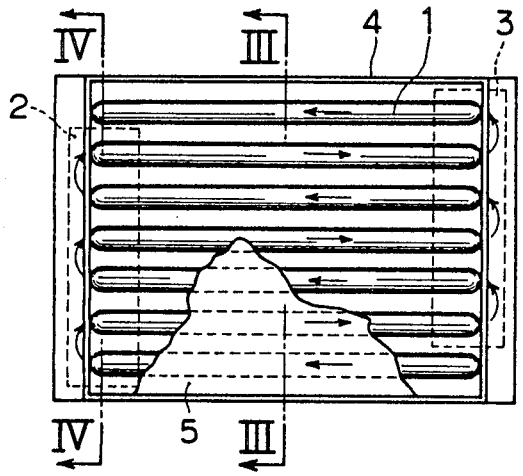
FIG. 1 is a partially cutaway front view showing an embodiment of the present invention.
Figure 2:
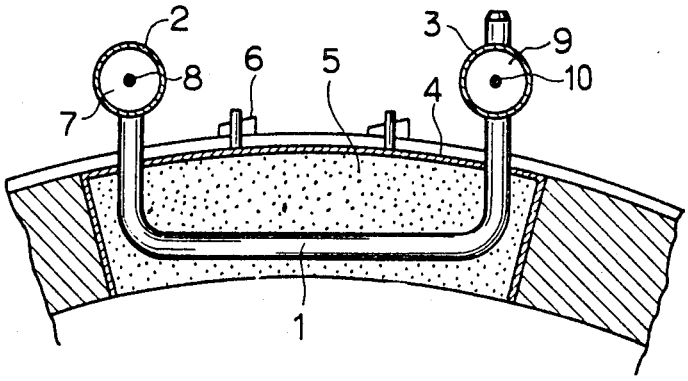
FIG. 2 is a sectional plan view showing a state where the embodiment of FIG. 1 is fitted to a furnace body.
Figure 3:
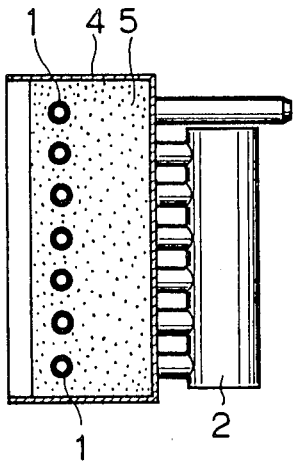
FIG. 3 is a sectional view taken along the Line III-III of FIG. 1.
Figure 4:
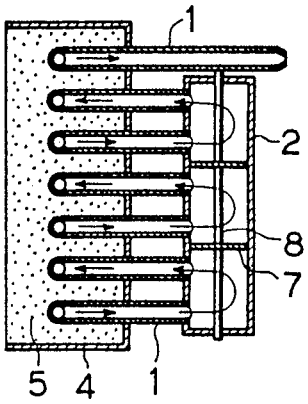
FIG. 4 is a sectional view taken along the line IV-IV of FIG. 1.
Figure 5:
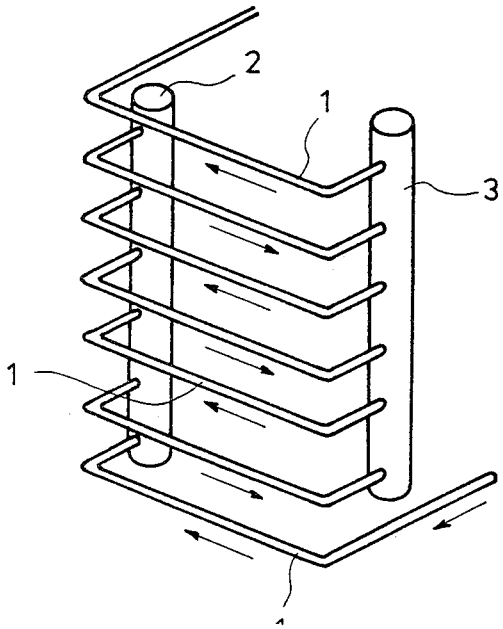
FIG. 5 is a perspective view showing cooling pipes of the present invention.

In FIGS. 1 to 5, reference numeral 1 indicates cooling pipes; 2 and 3, supporting pipes; 4, an outside board; 5, uniformed refractories such as castables, plastic mouldable, etc.; and 6, cotters. Both sides of a plurality of cooling pipes 1 arranged horizontally are fitted on the supporting pipes 2 and 3 for the cooling pipes. And as can be seen in FIGS. 2 and 4, the supporting pipe 2 contains a cooling medium reversing device with partition plates 7 fitted to a fixed shaft 8, and similarly, the supporting pipe 3 contains a cooling medium reversing device with partition plates 9 fitted to a fixed shaft 10. Therefore, the cooling medium in the supporting pipe 2 is turned back by the partition plates 7 as indicated by arrows in FIG. 4, and the same occurs also in the supporting pipe 3. Thus, the cooling medium flows as indicated by arrows in FIGS. 1 and 5, from a lower cooling pipe 1 to the cooling pipe 1 positioned immediately above, sequentially in series in one system.

In the cooling system since the cooling medium is reversed to flow in one system by the partition plates 7 and 8 provided respectively in the supporting pipes 2 and 3, the bubbles generated in the cooling medium in the cooling pipes 1 exposed to the high temperature in the furnace can be promptly discharged outside by letting the bubbles rise in the supporting pipes 2 and 3 positioned outside the furnace through proper clearances provided between each of the partition plates 7 and 8 and each inside surface of the supporting pipes 2 and 3, or through proper holes provided in the partition plates 7.

At the portions in contact with bubbles, the pipes 1 do not contact the cooling medium directly and rise in temperature very dangerously. However, in the above mentioned structure when bubbles occur, the bubbles can be promptly discharged.

Figure 6:
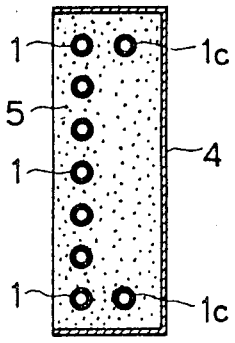
FIGS. 6 to 10 are sectional views showing first to fifth applications of the present invention, respectively.

In FIG. 4, the cooling pipes 1 are arranged vertically in one row. In FIG. 6, cooling pipes 1*c* are added at the uppermost and lowermost parts in the pipe arrangement shown in FIG. 4, to facilitate the stable laying of bricks and to intensify cooling even when the bricks in the lower part should wear.

Figure 7:
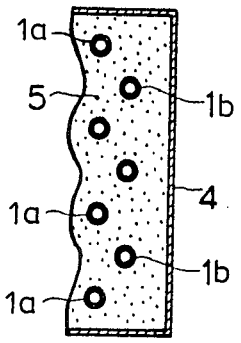

FIG. 7 shows cooling pipes 1*a* and 1*b* arranged zigzag in every other sequence. The row of the cooling pipes 1*a* positioned close to the inside of the furnace and the row of the cooling pipes 1*b* positioned away from the inside of the furnace form alternate arrangement of the pipes, to form the inside surface of the furnace unevenly along the arranged cooling pipes, for positively receiving splashed slag, etc. and stably holding the film. Thus, the small thermal conductivity of the film can be utilized to enhance the effect of heat insulation.

Figure 9:
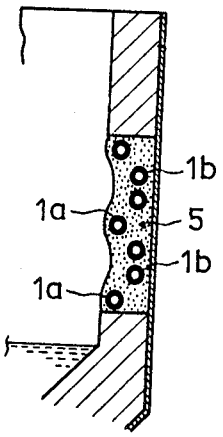

FIG. 9 shows an example in which sets of two cooling pipes 1*b* are arranged rearward.

Figure 8:
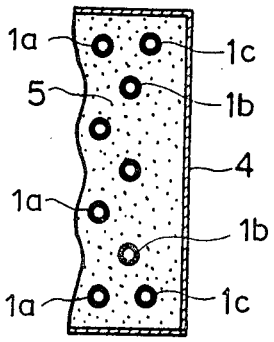
Figure 10:
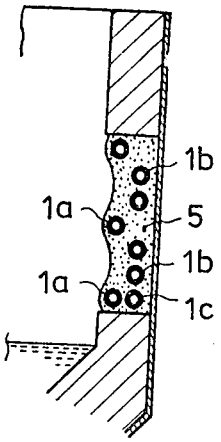

FIGS. 8 and 10 show examples where a cooling pipe or cooling pipes 1*c* are added to facilitate the stable laying of bricks and to intensify cooling even when bricks in the lower part should wear, as in case of the application shown in FIG. 6.

Figure 11:
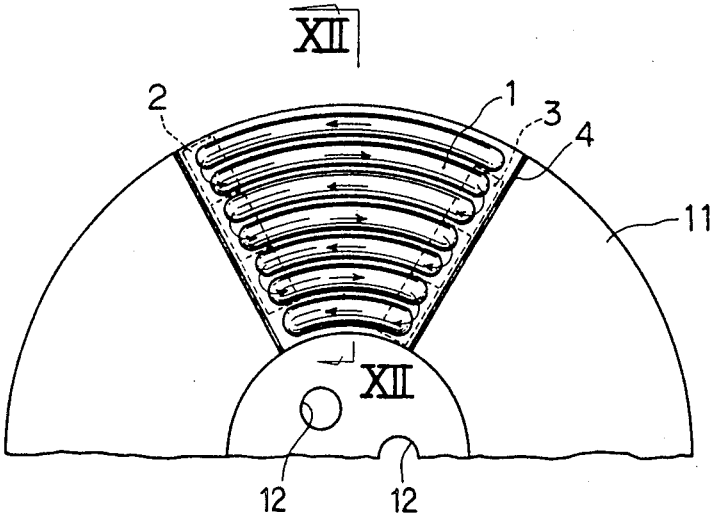
FIG. 11 is a partially cutaway plan view of a furnace roof showing the present invention embodied in the furnace roof.
Figure 12:
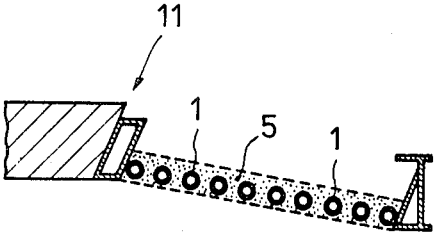
FIG. 12 is a sectional view taken along the line XII-XII of FIG. 11.
Figure 13:
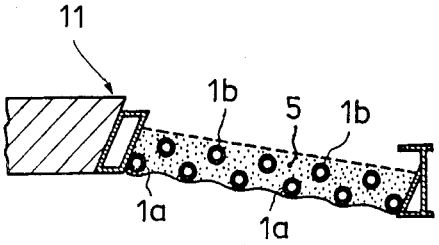
FIG. 13 shows a further application of the present invention in a furnace cover.

FIGS. 11 to 13 show examples where the present invention is embodied in a furnace roof 11. Like the examples mentioned before, many cooling pipes 1 are arranged horizontally, and both sides of these cooling pipes are fitted to the supporting pipes 2 and 3. And partition plates (not illustrated) are contained in the supporting pipes 2 and 3, to arrange said cooling pipes 1 in series, for letting the cooling medium flow in one system. In FIG. 11, reference numeral 12 indicates electrode holes.

In said examples, cooling pipes made of steel can be used in the upper part of the furnace wall and in the furnace roof where thermal load is low and cooling pipes made of copper can be used in the lower part of the furnace wall expecially opposite parts of electrodes where thermal load is high. The materials of the cooling pipes can be changed like this, according to the magnitudes of thermal load.

As mentioned above, since the present invention has many cooling pipes arranged horizontally with the cooling medium flowing in series in one system, the structure is simple, and the cooling effect is high, with long life secured. Furthermore, a flat form, a curved form according to the diameter of the furnace shell, and various other forms can be easily made compared with a structure made by forming cooling pipes serpentine coil, this structure can be made large without joining pipes halfway, and therefore the structure is very safe. In addition, when damaged, the cooling pipes can be easily exchanged. Since the structure can be made without any contacting relation between neighboring sections of the pipes and without any welded joint to the neighboring pipe, it is very safe against explosion, caused by leak of the cooling medium, etc.

The structure with cooling pipes arranged in ladder fashion can receive splashed slag on the uneven surface. Moreover, since the splashed slag between cooling pipes is directly cooled and perfectly congealed, and makes a strong slag layer compared with the structure formed by jacket or box plates and serpentine coil, it is free from the possibility of melting loss, etc., allowing the splashed slag film to be held stably for a long period. Furthermore, since the film is low in heat conductivity, it is high in the effect of heat insulation, preventing the drop of the thermal efficiency of the furnace and serving to elongate the life of the cooling structure.

What is claimed is:

1. A pipe-ladder type water-cooled panel for a wall or a roof of a steel-making arc furnace comprising a group of cooling pipes adjacent to the furnace inside and arranged in a row and in a ladder-form so as not to contact with each other, a space between the adjacent cooling pipes being at least enough for splashed slag to enter, and supporting pipes for supporting said cooling pipes and arranged so as not to be exposed to the furnace inside, said supporting pipes being adapted to have cooling water flow through said cooling pipes sequentially in series while reversing its flow direction at each of said cooling pipes.

2. A panel according to claim 1 wherein said cooling pipes are arranged zigzag.

3. A panel according to claim 1 wherein at least one of said supporting pipes is provided at its inside with a partition plate for reversal of the cooling water, and bubbles generated in the cooling water are discharged through clearances between the partition plate and an inside surface of the supporting pipe.

* * * * *